US007100837B2

(12) United States Patent
Young

(10) Patent No.: US 7,100,837 B2
(45) Date of Patent: Sep. 5, 2006

(54) RAIL SEAT ASSEMBLY

(75) Inventor: Hartley Frank Young, Melton (AU)

(73) Assignee: AirBoss Railway Products, Inc., Kansas City, MD (US)

( * ) Notice: Subject to any disclaimer, the term of this patent is extended or adjusted under 35 U.S.C. 154(b) by 44 days.

(21) Appl. No.: 10/814,629

(22) Filed: Apr. 1, 2004

(65) Prior Publication Data

US 2004/0200906 A1 Oct. 14, 2004

(30) Foreign Application Priority Data

Apr. 9, 2003 (AU) ..... 2003901653

(51) Int. Cl.
*E01B 19/00* (2006.01)

(52) U.S. Cl. ..... 238/382; 238/264; 238/283

(58) Field of Classification Search ..... 238/264, 238/283, 265, 280, 287, 382
See application file for complete search history.

(56) References Cited

U.S. PATENT DOCUMENTS

| | | | | |
|---|---|---|---|---|
| 4,379,521 A | | 4/1983 | Young et al. | |
| 4,618,093 A | | 10/1986 | Young et al. | |
| 4,971,247 A | * | 11/1990 | Harkus | 238/283 |
| 5,203,502 A | * | 4/1993 | Young | 238/283 |
| 5,692,677 A | | 12/1997 | Duconseil | |
| 5,730,357 A | * | 3/1998 | Besenschek et al. | 238/283 |
| 6,040,052 A | | 3/2000 | Kanazawa et al. | |
| 6,045,052 A | * | 4/2000 | Besenschek | 238/382 |
| 6,367,704 B1 | | 4/2002 | Mediavilla | |
| 6,604,690 B1 | | 8/2003 | Young | |
| 6,786,459 B1 | * | 9/2004 | Pilesi | 246/415 R |

FOREIGN PATENT DOCUMENTS

| | | |
|---|---|---|
| WO | WO 98/13550 | 4/1998 |
| WO | WO 02/31264 A1 | 4/2002 |

* cited by examiner

*Primary Examiner*—Mark T. Le
(74) *Attorney, Agent, or Firm*—Connolly Bove Lodge & Butz LLP

(57) ABSTRACT

A rail seat which includes a) a rail tie b) a pair of rail fastening support shoulders mounted on said rail tie so that a rail can be held to the tie between said shoulders each shoulder having a a rail face and side portions on each side of said rail face extending away from the rail c) a rail pad adapted to lie on said tie between said shoulders which has a pair of projections extending parallel to the tie along side each side portion of each shoulder.

The rail seat is adapted to be used with a deep post insulator and incorporates a rib on the support shoulder extending from each side portion against which a face of the rail pad projections abut to locate the pad in position to accommodate the post of the insulator. The rail pad projections are proportioned to prevent the pad from moving out of position under the creep load conditions present when rail cars pass over the rail seat. A resilient tab is provided on each projection to abut the side portions of the support shoulder to retain the pad in position between the support shoulders during transport of the rail tie to the installation site.

6 Claims, 4 Drawing Sheets

RAIL SEAT ASSEMBLY

FIELD OF THE INVENTION

This invention relates to rail roads and in particular preassembled rail fastening components for rail ties.

BACKGROUND TO THE INVENTION

Rail pads are used to electrically and dynamically insulate the rail tie from the rail and U.S. Pat. Nos. 4,618,093 and 5,203,502 are examples of rail pads used with elastic rail clip support shoulders that are fixed to the tie on either side of the rail.

Often shims and gaskets are also placed under the rail pad.

It is now common practice for the rail pads to be placed in the rail seats at the rail tie manufacturing plant in order to save time at the track installation. The ties are usually stacked on flat rail cars at the tie plant. There may be 4 layers of ties with wooden dunnage between each layer. The dunnage sits on the rail seats. The pads gaskets and shims on the top layer may be blown off in transit or from any tie during installation. If this is not noticed and the rail ties are fed onto the track this can create difficult problems as the rail is automatically fed onto the ties even if the pads are not in place. Then the pads must be inserted after the mobile tie installation machinery has passed. This is difficult expensive and time consuming.

Anther component of the rail fastening system is the insulator that lies between the rail and the rail fastener. U.S. Pat. No. 4,379,521 is an example of such an insulator.

A recent development affecting the design of rail pads has been the adoption of deep post rail insulators where the portion of the insulator lying between the support shoulder and the rail flange extends below the bottom of the rail which means that the rail pad has to be modified to accommodate the deep post insulator. The deep post insulator can be accommodated by making a cut out in the edge of the pad. However this means that this type of pad is not suitable for pre assembly with the shoulders because it needs to be precisely located between the shoulders to accept the insulator post and it is difficult to reposition the pad when the rail is sitting on it. One attempt as shown in U.S. Pat. No. 5,692,677 has been to make the vertical post of the insulator slightly shorter so that a thin section of pad remains to locate the pad against the shoulder. The difficulty of this approach is that the thin section abutting the shoulder is not strong enough to locate the pad against the shoulder.

Another difficulty with insulators of the type disclosed in U.S. Pat. No. 4,379,521 is that they wear out or break before the other components in the rail seat. A problem associated with rail pads has been that under the creep load conditions such as on slopes the rail under the load of trains passing tends to creep relative to the rail seat and under this force the pad may be forced out of position . One approach to dealing with that problem is to provide an upstanding projection on the outer edge of the pad adjacent the insulator so that movement of the pad would be inhibited because movement of the post would be resisted by the insulator. This approach still allows considerable pad movement because of the tolerances required to ensure that the insulators could be fitted.

It is an object of this invention to address the above mentioned problems.

BRIEF DESCRIPTION OF THE INVENTION

To this end the present invention provides a rail seat which includes a) a rail tie b) a pair of rail fastening support shoulders mounted on said rail tie so that a rail can be held to the tie between said shoulders each shoulder having a a rail face and side portions on each side of said rail face extending away from the rail c) a rail pad adapted to lie on said tie between said shoulders which has a pair of projections extending parallel to the tie along side each side portion of each shoulder.

When a deep post insulator is used on the rail seat the side portions of the shoulders each have a projection which abuts the end of the projections on the rail pad. The pad thickness below the insulator is reduced in thickness or eliminated to provide clearance for the insulator. The recess for the deep post insulator may incorporate a web that is a thin extension of the rail pad above which the post of insulator is located. Because this portion of the pad is thin and flexible or non existent it can not provide a positive register for the pad against the support shoulder. This problem is overcome by providing pad projection blocks to abut the sides of the support shoulder to positively locate the pad and ensure that the cavity for the deep post insulator is in the correct position. The provision of a web is preferred because it strengthens the pad and resists forces that could tear the projection blocks away from the body of the pad In one embodiment the rail pad body is dimensioned to be no wider than the base cross section of the rail so that there is a recess between the rail face of the shoulder and the main body of the rail pad to accommodate the deep post of the insulator. The projections on the sides of the shoulders may take the form of ribs and enable the pads to be correctly located so that an appropriate recess is formed between the pad and each shoulder. An alternative and preferred method method is to use a thinner section of pad below the insulator to locate against the rail face of the shoulder.

In another aspect this invention provides a recess in the rail pad adjacent the rail face of the support shoulder which is as wide as the rail face of the support shoulder. This ensures that the insulator post has the maximum bearing area between the insulator and the support shoulder.

The pad projections abut the sides of the shoulders so that under creep load conditions any tendency of the pad to move is resisted by the sides of the shoulders. The portion of the pad projections abutting the sides of the shoulders may be thickened in the vertical direction to further inhibit pad movement.

In order to retard displacement of the pads prior to the rail being placed in position the pad projections have resilient tabs projecting laterally toward the sides of the shoulders so that they are deformed when the pads are placed on the rail seat to create a force fit between the pads and the shoulders to prevent accidental displacement of the pads during transit and installation.

BRIEF DESCRIPTION OF THE FIGURES

A preferred embodiment of the invention will be described with reference to the drawings in which.

DETAILED DESCRIPTION OF THE INVENTION

Figure 1:
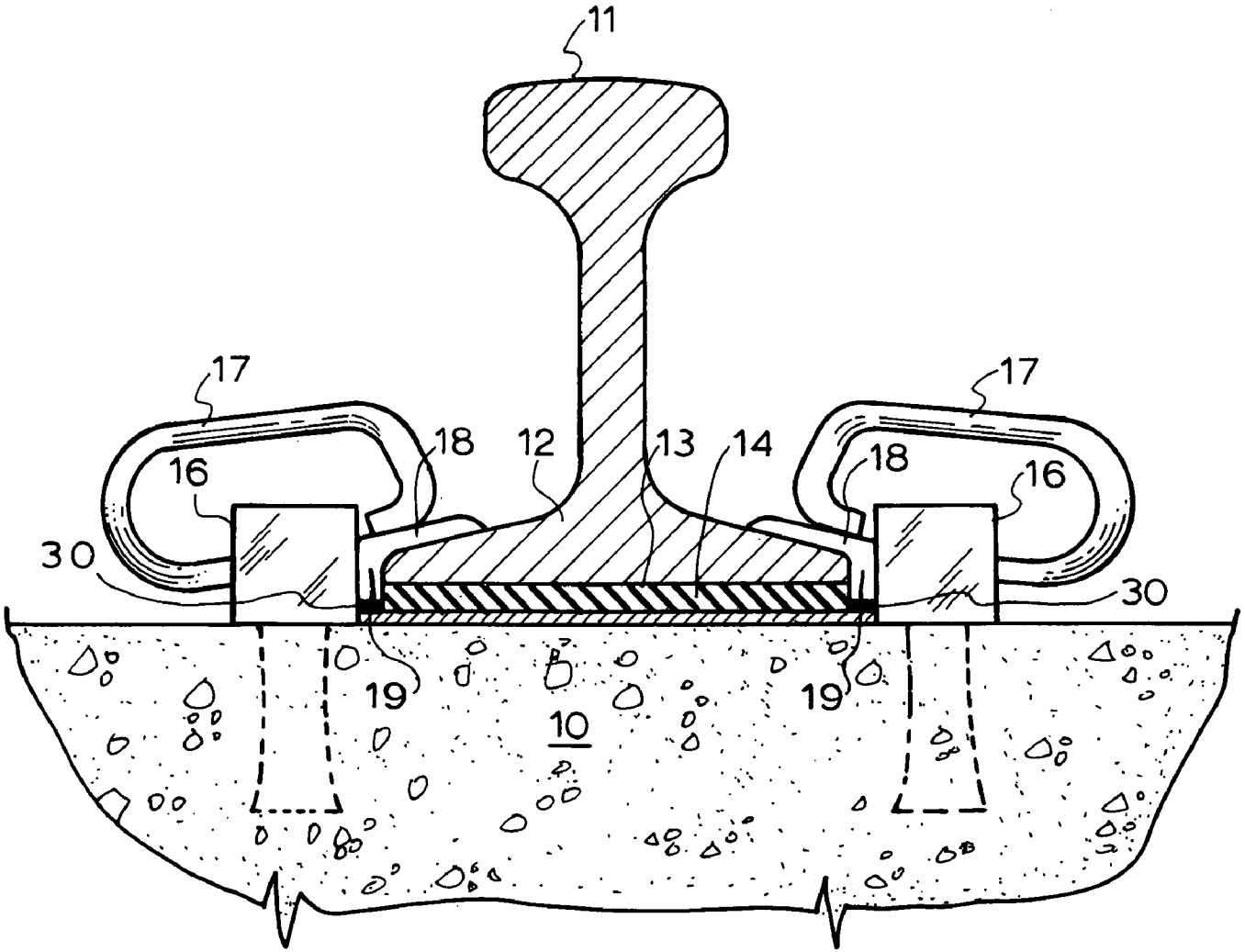
FIG. 1 is a schematic cross section of a rail seat to which this invention applies.
Figure 2:
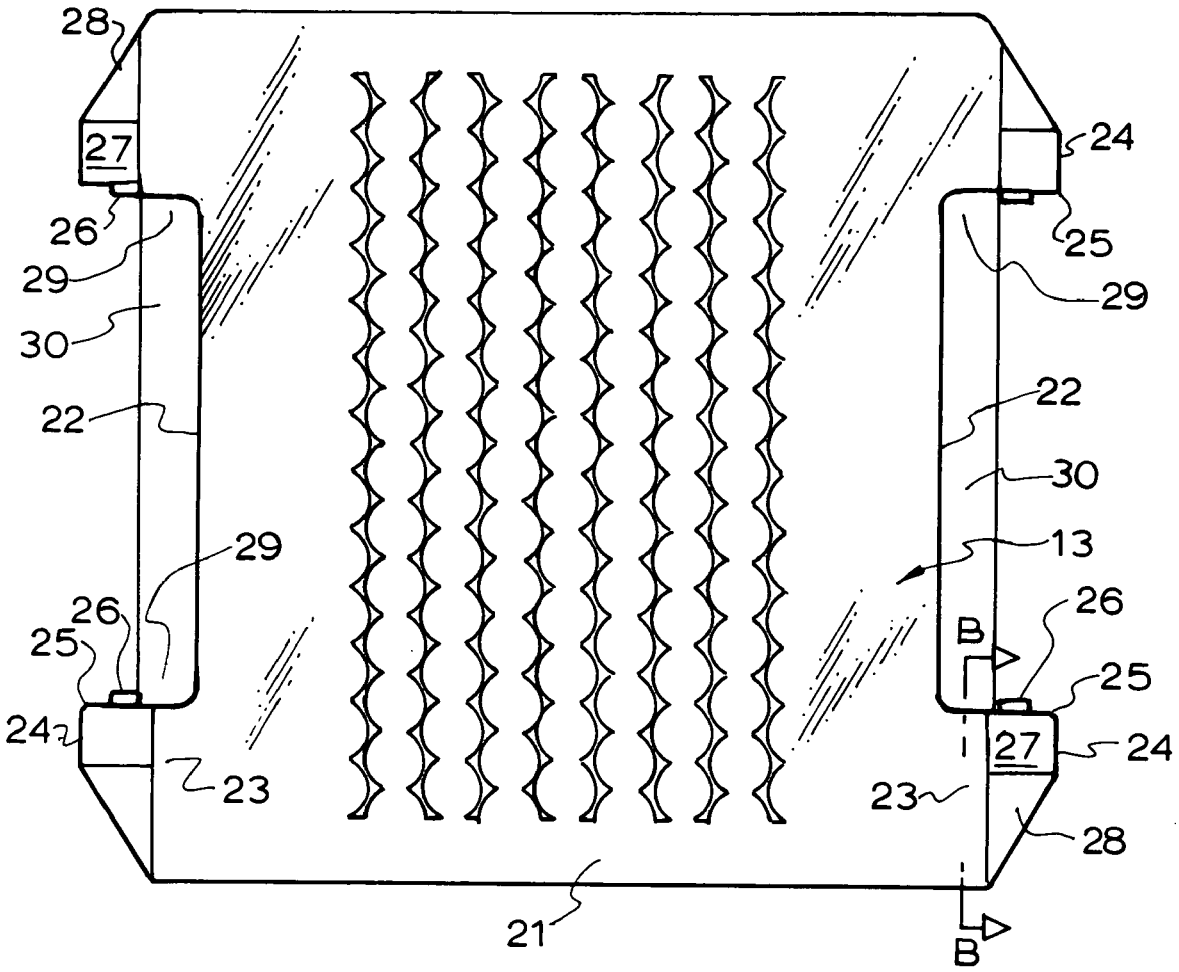
FIG. 2 is a plan view of a rail pad according to this invention.
Figure 3:
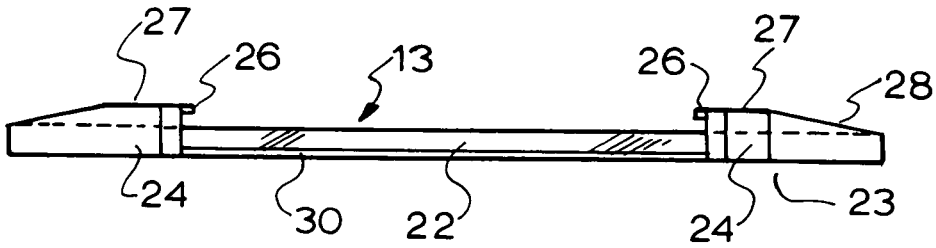
FIG. 3 is a is a side view, from the rail support shoulder, of the pad of FIG. 2.
Figure 4:
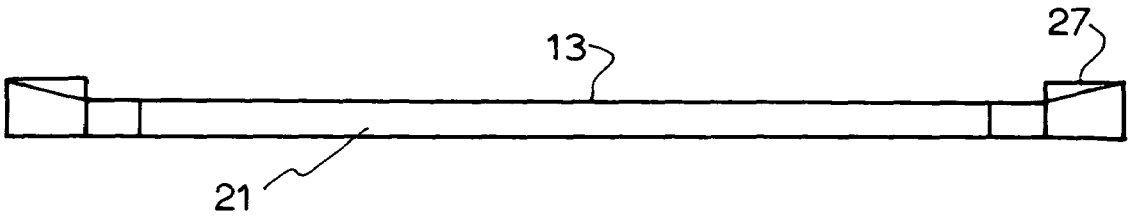
FIG. 4 is an end view along the line of the rail of the pad of FIG. 2.
Figure 5:
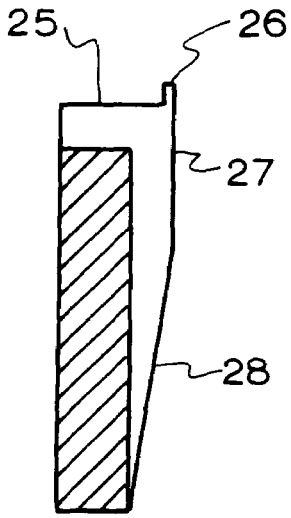
FIG. 5 is the section B—B along the line B—B in FIG. 2.

The rail seat of this invention is based on concrete rail seats as described in U.S. Pat. Nos. 4,618,093 and 6,045,052 except that a deep post insulator is used which has a vertical portion which fits between the rail base and the rail clamp support shoulder and extends downwardly below the level of the bottom edge of the rail. The rail seat consists of a rail tie 10 having cast in place clamp shoulders 16 to which rail clamps 17 are fitted. These clamps 17 hold the rail 11 in place. The rail base 12 lies on a rail pad 13 which in turn lies on a rail plate 14. A deep post insulator 18 lies between the rail base 12 and the toe of the rail clamp 17 and the rail face of the support shoulder 16. In this embodiment a deep post insulator 18 is used and the post 19 extends below the bottom edge of the rail base 12 into a recess provided in the rail pad 13.

The rail pad 13 is made from a hard elastomeric material such as natural or synthetic rubber or polyurethane. The central portion may incorporate any suitable arrangement of grooves and recesses as taught in a number of prior art patents such as U.S. Pat. Nos. 4,618,093, 6,045,052 or WO 98/13550.

The pad 13 which lies under the rail, has edges 21, extending at right angles to the rail and edges 22, lying parallel and substantially below the edges of the rail base.

Figure 6:
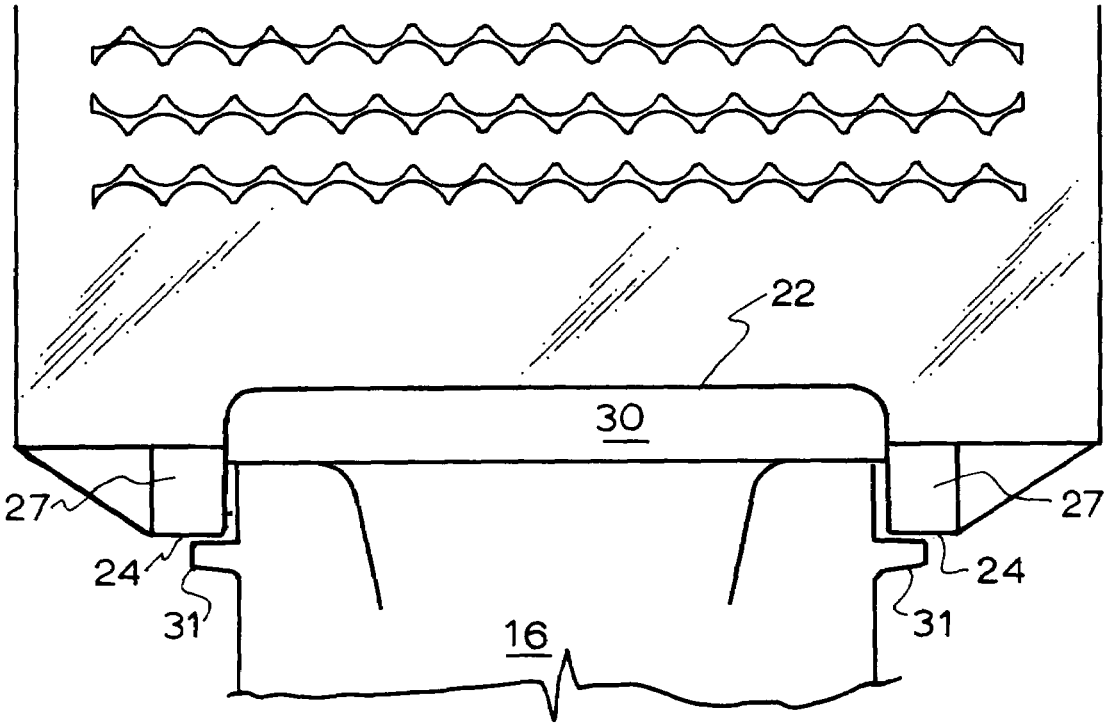
FIG. 6 is a plan view of the pad located against a support shoulder.

The corner projections 23 of pad 13 consist of a vertically thickened portion 27 having a face 25 which carries the gripper tab 26 and a face 24 which abuts the rib 31 of the rail support shoulder as shown in FIG. 6.

The pad is located correctly in position between the support shoulders by the thickened projections 27. The faces 24 abutting the ribs 31 of the support shoulders 16 ensure that the pad lies beneath the rail flange so that there is a gap between the edge 22 and the rail face of the support shoulder to accommodate the deep post insulator. Recesses 29 are slightly greater in width than the thickness of the post of the insulator and space the portion 27 away from the line of edge 22. The base 30 of the recess 29 is provided to reinforce the pad and reduce the likelihood that the portion 27 will be torn off under the rail creep loads that the rail seat is subjected to. If desired the base 30 of the recess 29 can be eliminated but it is usually preferred.

The large area face 25 of each thickened corner projection 23 abuts the sides of the support shoulders to inhibit any tendency of the pad to move under the creep load conditions experienced during the passing of rail cars over the rail seat. The tab 26 on face 25 ensures that the pad 13 is held tightly to the shoulder to prevent accidental displacement during shipping of the assembled rail tie from the manufacturing plant to the track location. The tab 66 is resiliently deformed when the pad 13 is pressed into position between the pair of rail clamp support shoulders.

From the above it can be seen that the present invention has uniquely solved problems associated with preassembled rail seats. Those skilled in the art will realize that the present invention may be put into practice in embodiments other than those described above without departing from the inventive concepts.

The invention claimed is:

1. A rail seat having a rail pad adapted to lie on a rail tie that supports a rail between rail fastening support shoulders and which includes:

a) a pair of transversely oriented rail fastening support shoulders mounted on said rail tie in spaced relationship to respective base edges of the rail, each shoulder having a surface confronting the rail base edge and lateral surfaces extending away from the rail base edge;

b) a generally rectangular rail pad positioned on said tie, between said shoulders, the pad having projections at each corner of the pad, each projection including a raised thickened portion abutting a respective lateral surface of the support shoulder;

c) an insulator having a post portion lying between the rail confronting face of the support shoulder and an edge of the rail pad that underlies a respective base edge of the rail;

d) wherein each support shoulder has a projection extending from each said lateral surface thereof for abutting an outward surface of the raised thickened portion of the rail pad thereby locating the pad in a position to accommodate the post portion of the insulator.

2. A rail seat as claimed in claim 1 together with a recess formed along each outward edge of the pad for receiving a respective post of the insulator, the recess having a web which is a thin extension of the rail pad main body on which the insulator seats.

3. A rail seat as claimed in claim 1 in which the raised thickened portion abutting a respective lateral surface of the support shoulder includes a surface from which extends a resilient tab which creates a force fit between the rail pad and the support shoulder.

4. The rail seat set forth in claim 1 wherein each raised thickened portion tapers downwardly, along a direction parallel to the rail base edge and away from the support shoulder.

5. The rail seat set forth in claim 1 wherein the insulator is a deep post insulator.

6. A rail pad for use in a rail seat of claim 1 and adapted to lie on a rail tie between rail fastening support shoulders, the pad further comprising:

a) said projections extending parallel to the tie alongside respective lateral surfaces of each shoulder, said projections having a vertical thickness greater than the rest of the rail pad;

b) in a recess for the post portion of the insulator, a web which is a thin extension of the rail pad on which the post insulator seats; and c) on the surface of said projections which abut said lateral surfaces of the support shoulders, a resilient tab which creates a force fit between the rail pad and the support shoulder.

* * * * *